United States Patent [19]

Delery

[11] 4,447,970

[45] May 15, 1984

[54] SKI BOOT

[75] Inventor: Marc Delery, Caluire, France

[73] Assignee: Compagnie Francaise d'Articles de Sport, France

[21] Appl. No.: 341,077

[22] Filed: Jan. 20, 1982

[30] Foreign Application Priority Data

Jan. 20, 1981 [FR] France ..... 81 01109

[51] Int. Cl.[3] ..... A43B 5/04

[52] U.S. Cl. ..... 36/121

[58] Field of Search ..... 36/121

[56] References Cited

U.S. PATENT DOCUMENTS

| | | | |
|---|---|---|---|
| 3,374,561 | 3/1968 | Werner et al. | 36/121 |
| 3,521,385 | 7/1970 | Dalebout . | |
| 3,633,291 | 1/1972 | Caporicci . | |
| 4,085,528 | 4/1978 | Delery . | |
| 4,282,658 | 8/1981 | Hanson et al. | 36/121 |

FOREIGN PATENT DOCUMENTS 8020898 6/1980 Fed. Rep. of Germany .

*Primary Examiner*—Patrick D. Lawson

*Attorney, Agent, or Firm*—Parkhurst & Oliff

[57] ABSTRACT

A ski boot consisting of a shell to receive the foot and of a rear collar hinging on the shell to snugly fit against the leg, the shell comprising on its rear side a raised molding pointing outward for the purpose of limiting the displacement of the collar on the shell, characterized in that the collar at its lower part comprises a raised molding parallel to the raised molding on the shell but pointing into the boot and capable of resting on said molding on the shell, and the shell comprises at its rear part a compressible element capable of resting on and cooperating with said raised molding of the collar when said collar moves on the shell.

5 Claims, 6 Drawing Figures

SKI BOOT

BACKGROUND OF THE INVENTION

The invention concerns a novel type of ski boot, in particular one made from injection molded plastics.

When skiing, in particular when on edge, moving over elevations or jumping, the leg frequently exerts forward stresses on the boot.

In conventional boots consisting of a shell and a collar, no provision is made to return the collar from the front to the rear unless by the leg itself. But it is mandatory that this collar be moved back quickly into the rear support position so that in the event of a new forward stress, the same angular leg displacement will once again be possible.

It was initially proposed to control the elasticity of both the shell and the collar materials. Unfortunately, this elasticity depends on the temperature and eventually renders the collar oval.

Then it was proposed to use either a technical bow means passing through the sole and resting on the rear of the boot (U.S. Pat. No. 4,085,528) or a shock absorber located in the boot sole. These solutions are very successful, but unfortunately are still fairly costly and therefore cannot be employed in the so-called lower or economy range.

Recently it has been suggested with respect to boots used in competition that a spring which joins the shell and the collar at the heel level be placed externally on the rear of the boot to dampen these flexions. This solution is still costly and, moreover, bulky and often incompatible with certain safety binding means. Furthermore, and most important, it withstands repetitive stresses poorly as all of the stresses from the collar are transmitted only by rivets or the like to the spring.

SUMMARY OF THE INVENTION

The present invention relates to a novel type ski boot with shock-absorber, which is economical, compact and adapts to all safety binding means.

This ski boot consists of a shell for seating the foot and of a rear collar hinging on the shell to enclose the leg wherein the shell comprises on its rear side of a raised horizontal molding directed to the outside and meant to limit the displacement of the collar on the shell. This boot is characterized in that the collar at its lower part comprises a raised molding parallel to the above molding but directed into the boot and capable of resting on said shell-supported molding, and the shell comprises on its rear part a compressible element which can rest on and function in concert with said raised molding on the collar when said collar moves on the shell.

Practically, the raised molding on the shell points outward and is located in the horizontal plane passing through the malleoluses of the wearer.

In a first embodiment, the compressible element is formed by a small tongue integrally molded with the shell and located at the heel, comprising corrugations to make it compressible. In a variation, this compressible element consists of a series of three-dimensional moldings formed on the inside of the collar and parallel to the three-dimensional molding also on the collar, on which come to rest a series of deforming laminae also made by integral molding with the rear side of the shell.

In a second and preferred embodiment, the shell comprises a second raised molding parallel to the first and also directed outward, these raised moldings thereby defining a chamber for seating said compressible element. This compressible element may consist of a spring or a set of helical springs. Advantageously, the compressible element is made of a low-hysteresis elastomer body. In practice this elastomer body assumes a tapered roof-tile shape with rounded off side ends to fit the rear shape of the shell, and is perforated by horizontal holes.

In a variation, a plate parallel to the raised moldings comprises means to precompress the compressible element.

The illustrative and non-limiting examples below provided in relation to the attached figures show the manner in which the invention can be implemented and several of its advantages.

THE DRAWINGS

Figure 6:
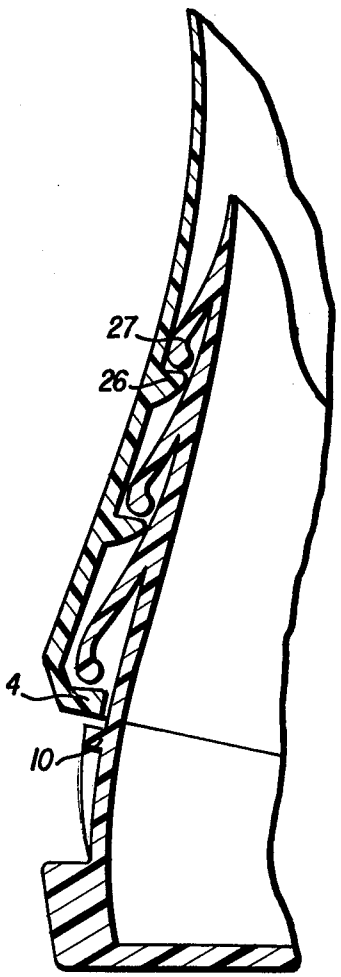
Figure 5:
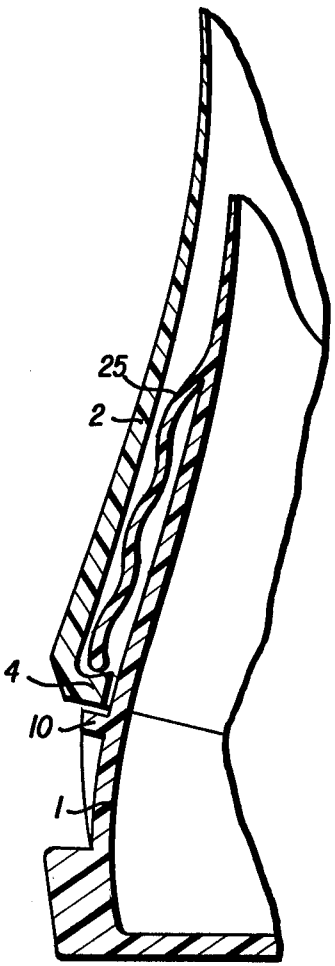

FIGS. 5 and 6 each show another embodiment of the invention.

DETAILED DESCRIPTION OF THE INVENTION

Figure 2:
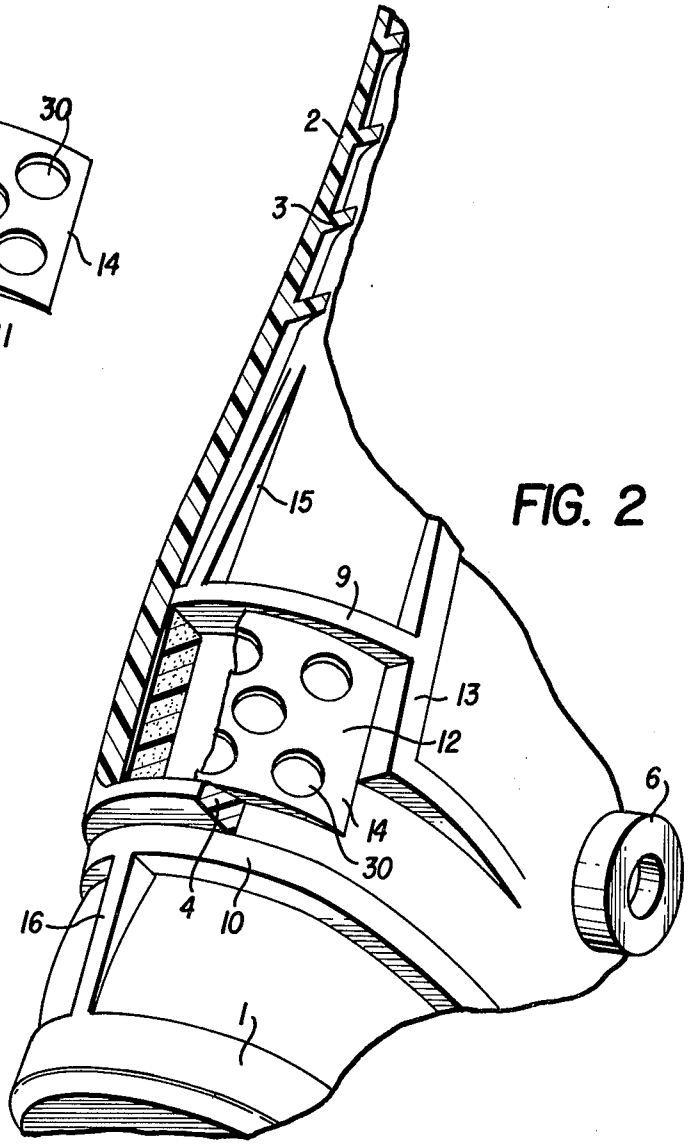
FIG. 2 is a perspective schematic view of the rear of a preferred embodiment of a boot of the invention.
Figure 3:
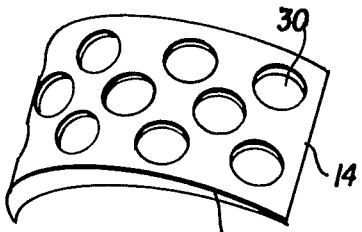
FIG. 3 is a perspective view of an applicable shock absorber.
Figure 1:
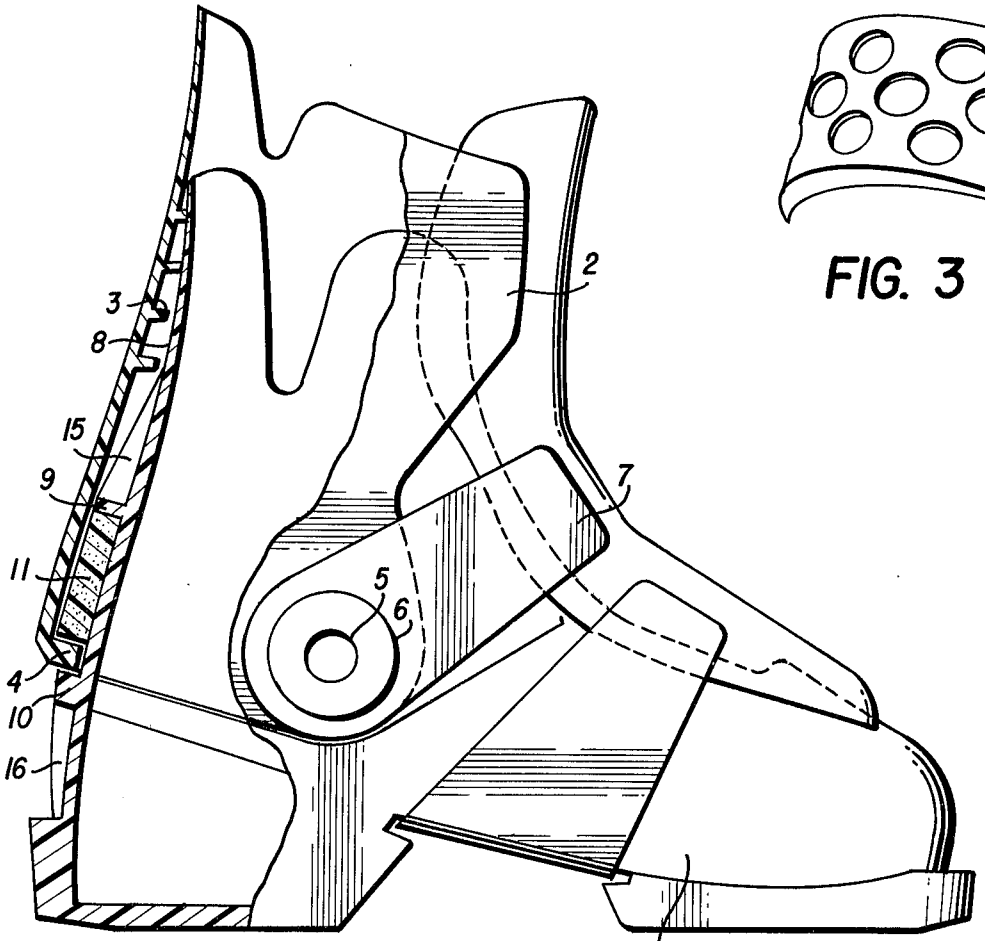
FIG. 1 is a schematic section of a boot fitted in the manner of the invention.

Referring now to FIGS. 1 through 3, the ski boot of the invention consists of:

an appropriate injection-molded plastic shell 1, for instance made of polyurethane, ABS, polyamide 11 filled or not with glass fibers, a collar 2 made of the same material but preferably more rigid than the shell for the purpose of transmitting the stress and provided with raised moldings 3 for reinforcing the collar 2 and lessening the contact areas between the collar 2 and the shell 1.

At the horizontal plane passing approximately through the malleoluses of the wearer, the shell 1 comprises an integrally raised molding 10 pointing outward, for instance 1 cm deep and 0.5 cm high; this horizontal molding 10 is kept in place by a vertical molding 16 acting as a rear support point both to limit the rearward excursion of the collar 2 and the travel of the shock absorber 11.

The collar 2 hinges about the shell 1 at 5, substantially at the malleolus level, and in the diagonal from the heel to the instep. In particular, this collar 2 hinges at 5 by means of a hinge rivet 6 joining the collar and the shell. The reference numeral 7 denotes a diagonal strap for conventional buckles (omitted).

The rear side 8 of the shell 1 comprises a molding 9 parallel to the molding 10 and of the same dimensions, that is, about 1 cm deep and 0.5 cm high, which is kept in place by a perpendicular molding 15 also obtained by integral molding. A shock absorber 11 is placed in the chamber 12 shown in FIG. 2 defined by the upper outwardly pointing molding 9 and the molding 4 at the bottom of the collar 2 but pointing inward, said shock absorber being of the shape shown in FIG. 3, namely a tapering elastomer body rounded of at its ends 14.

The material constituting this elastomer body 11 must be compressible and its hysteresis must be very slight so as to be free of substantial fatigue when subjected to compression, and further it must be rather temperature-insensitive. The expert therefore can select suitable materials accordingly. As already stated, polyurethane is advantageously used. In a practical embodiment, this body 11 is made of a dense injection molded A75 Shore perforated with holes 30 from the shell 1 to the rear of the collar 2 and with the following dimensions: 10 mm thick, 30 mm high, full width 50 mm, and, as shown in FIG. 3, in the shape of a roof tile to fit snugly and easily into the rear of the boot. The hardness of this elastomer body 11 can be a function of the expected stresses (for instance 50 to 60 degrees Shore B depending on size).

The molding 10 pointing outward and supported in the shell 1 and holding up another perpendicular molding 16 already used conventionally in present-day ski boots serves to stop and to limit the displacement of the collar on the shell when coming to rest on the rear of the shell.

The chamber 12, defined by the raised moldings 4 and 9, further comprises lateral reinforcements 13 shown in FIG. 2 to keep the compressible body 11 in place and to avert deforming the shell 1 by the pressure from this compressible material.

Reference numerals 15 and 16 denote stiffening reinforcements for the moldings 9 and 10, respectively, located in the plane of the boot joint.

In one advantageous embodiment, the bottom of the collar 2 is provided just above the outwardly pointing raised molding with an aperture to disclose that the material making up the compressible element 11 is still in good condition.

Figure 4:
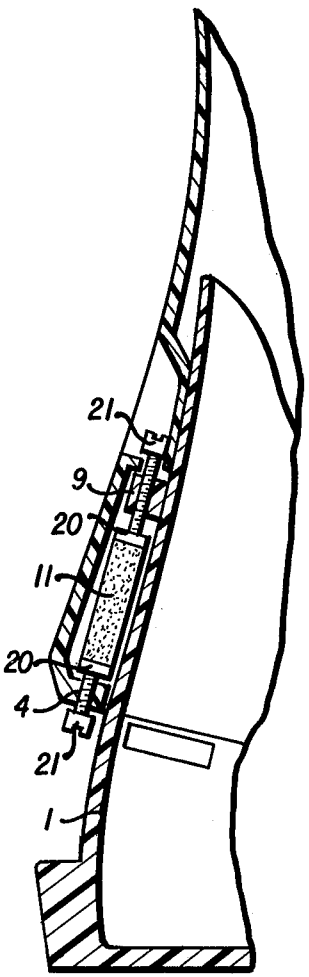
FIG. 4 is a schematic section of another embodiment of the invention.

In a variation shown in FIG. 4, the compressible material 11 is associated with two plates 20 placed on its two lateral surfaces, for instance consisting of sheet-metal and parallel to the plane of the moldings 4 and 9, where these plates are fastened to screws 21 for precompressing the body 11. In this manner the hardness of the compressible element can be controlled.

In another embodiment shown in FIG. 5, the rear of the shell 1 comprises a compressible element consisting of a molded, wavy small tongue 25 of the same material as the shell which joins the shell at the level of the Achilles tendon of the wearer. When the roller 2 moves forward due to its rotation about the axis 5, this small tongue will be compressed in the chamber formed between the molding 4 at the bottom of the collar and its point of attachment to the main body of the shell. When the forward rest position ceases, the corrugations assume the function of springs and return the collar to the rear rest position.

In still another embodiment, shown in FIG. 6, the rear side of the shell comprises a series of integrally molded deforming laminae 27 which are fastened to the rear of the shell 1, and the collar 2 is provided with a set of moldings 26 parallel to the raised molding 4 which also point to the inside of the boot and wherein are seated these deforming laminae 27. In the course of forward flexions, these laminae 27 deform on the moldings 26 and thus absorb the displacement. On the other hand, after cessation of the forward flexions, the elastic effect of the laminae ensures that the collar 2 shall return to the rear.

It should be obvious that the dimensions and the positions of the two raised characteristic moldings 9 and 4 are determined and computed to allow the hinging of the collar 2 around the shell 1.

In another embodiment, the compressible material 11 can be replaced by one or more helical springs arranged in the vertical direction.

The ski boots of the invention are easily manufactured, do not require special equipment, lack any particular bulk at the boot's rear and can easily be adapted to all commercial safety binding means. In other words, the invention allows manufacturing a ski boot wherein the flexions are dampened in an economical and satisfactory manner.

I claim:

1. An improved ski boot comprising a shell to receive the foot and a rear collar hinging on the shell snugly to fit with the shell, said rear collar hinged on the shell at the level of the malleoluses of the wearer of the boot, and comprising on its rear side a raised horizontally molding pointing toward the interior of the boot, the shell comprising at its rear a compressible element located in the chamber housing defined with the bottom of the collar, said compressible element cooperating with the collar where said collar moves on the shell, wherein:

the shell comprises at its rear a raised horizontal molding pointing outward and parallel to the molding pointing inward, for the purpose of limiting the motion of the collar on the shell, said molding pointing outward being located in an horizontal plane comprising the malleoluses of the wearer.

2. The ski boot of claim 1, wherein the compressible element is formed by a small integrally molded tongue joining the shell at the level of the Achilles' tendon of a wearer of the boot and provided with corrugations.

3. The ski boot of claim 1, wherein the compressible element comprises a set of deforming, integrally molded laminae joined to the rear side of the shell, which cooperate with a series of moldings on the inside of the collar and parallel to the raised molding of the collar.

4. The ski boot of claim 1, wherein the compressible element is a low-hysteresis elastomer body in the shape of a tapered roof tile rounded off at the ends for the purpose of snugly fitting against the rear shape of the shell, which body is perforated by holes passing from the shell to the rear collar.

5. The ski boot of claim 1, further comprising a plate parallel to the raised moldings of the shell and collar, and means for precompressing the compressible element.

* * * * *

UNITED STATES PATENT AND TRADEMARK OFFICE

CERTIFICATE OF CORRECTION

PATENT NO. : 4,447,970

DATED : May 15, 1984

INVENTOR(S) : Marc Delery

It is certified that error appears in the above-identified patent and that said Letters Patent is hereby corrected as shown below:

Claim 1, line 3, "shell" should read --leg--.

Signed and Sealed this

*First* Day of *January 1985*

[SEAL]

*Attest:*

GERALD J. MOSSINGHOFF

*Attesting Officer*

*Commissioner of Patents and Trademarks*